United States Patent [19]

Smies et al.

[11] 4,200,952

[45] May 6, 1980

[54] DEVICE FOR CLEANING FLOORS BY MEANS OF A LIQUID

[75] Inventors: Jan F. Smies, Amsterdam; Leo Dijkmans, Haarlem, both of Netherlands

[73] Assignee: Cemsto B.V., Amsterdam, Netherlands

[21] Appl. No.: 958,497

[22] Filed: Nov. 7, 1978

[30] Foreign Application Priority Data

Nov. 15, 1977 [NL] Netherlands ..... 7712580

[51] Int. Cl.[2] ..... A47L 11/20

[52] U.S. Cl. ..... 15/322

[58] Field of Search ..... 15/320, 321, 322, 345, 15/346

[56] References Cited

U.S. PATENT DOCUMENTS

| | | | |
|---|---|---|---|
| 1,199,201 | 9/1916 | Mote et al. | 15/345 |
| 2,497,435 | 2/1950 | Branneman | 15/321 X |
| 2,909,800 | 10/1959 | Grindle et al. | 15/321 |
| 3,436,787 | 4/1969 | Wisdom | 15/322 X |
| 3,447,188 | 6/1969 | Maasberg | 15/346 X |

*Primary Examiner*—Christopher K. Moore

*Attorney, Agent, or Firm*—Cushman, Darby & Cushman

[57] ABSTRACT

A device for cleaning floors with the aid of a liquid comprising: a hollow, elongated suction mouth piece having a longitudinal axis and having an elongated suction port extending along the lower surface thereof parallel to said longitudinal axis, a suction tube connected to the mouth piece and communicating at one end with the interior of the mouth piece, the suction tube having an opposite end for connection with a suction device; a spray nozzle mounted adjacent each end of the elongated suction mouth piece, said nozzles being directed downwardly and inwardly toward each other.

4 Claims, 1 Drawing Figure

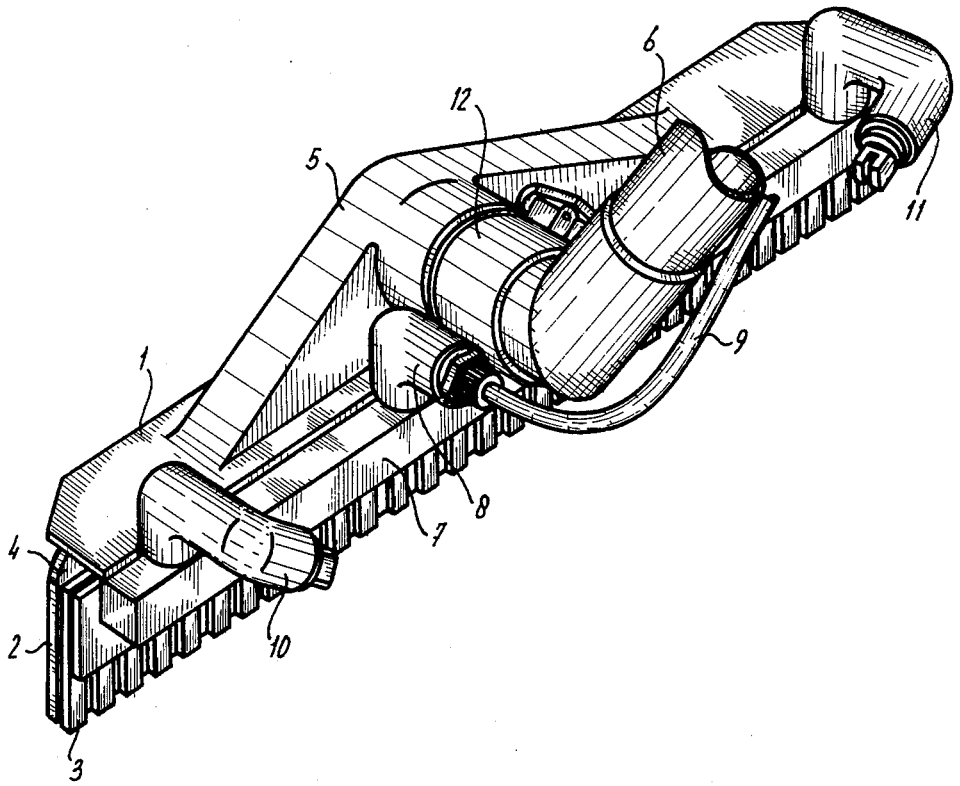
1
2
3
4
5
6
7
8
9
10
11
12

DEVICE FOR CLEANING FLOORS BY MEANS OF A LIQUID

This invention relates to a device for cleaning floors with the aid of a liquid, said device comprising a tube, said tube at its one end being in communication with a suction means and at its other end opening into an elongated suction mouth-piece, and a conduit, which at its one end is in communication with a source of a cleansing fluid under pressure and at its other end in communication with at least one spray nozzle, said nozzle being mounted at a fixed position above the suction port of the suction mouth-piece and being directed towards a point lying beyond one of the long sides of the suction mouth-piece.

Hard sealed floors, particularly in hospitals etc. should be cleaned to extremely high hygienic standards. Dirt, stains and wet spots may be sources of infection and dirt may act as a carrier of micro-organisms. Cleaning should be done in such a way that wet spots and stains are absorbed, so that substantially no residues are left behind, that the dirt is not spread and that the growth of bacteria is prevented during the process of floor cleaning with the aid of a liquid. Dust should be removed in such a way that it is not dispersed, or spread otherwise.

In doing so, cleaning should be done rapidly to avoid high costs and, in addition, the floors must be out of use for as short a time as possible in view of their continuous use e.g. in hospitals or nursing homes.

A cloth or mop and a cleansing fluid, used in common practice, are not adequate; parts of the floor will stay wet for quite a long time and a considerable amount of dirt stays behind on the wet surface. During the drying process there is an increased risk of infection.

Dust will be removed effectively without dispersion by cleaning with the aid of damp cloths, swabs or impregnated fabrics but wet spots and stains will not be removed with these aids so that a separate action is involved to remove wet spots and stains.

When vacuum cleaners are used, there is the possibility that extremely fine dust is carried along with the exhaust air through the bag, whereby the fine dust particles may be loaded with micro-organisms. Also in this case, a second process is required to remove wet spots and stains.

For proper floor cleaning, in which the above-mentioned requirements are met in some degree it has been proposed to use a device of the aforementioned type. In this device, a cleansing fluid is sprayed onto the floor when the suction mouth-piece is being moved over the floor to be cleaned, said fluid being sucked up again immediately thereafter through the suction mouth-piece.

In said known device, in most cases there is only one spray nozzle which is secured to the suction tube; thus, the spray nozzle is located in the center plane of the suction mouth-piece extending perpendicular to the longitudinal axis of said suction mouth-piece. In the case of wider suction mouth-pieces, several spray nozzles may be used which are positioned in parallel on the suction mouth-piece, so that the liquid jets are equidirectional; they are directed in the same direction as in the case of only one spray nozzle.

The cleaning action of said known device on smooth surfaces leaves still much to be desired, particularly, since stains are hard to remove with said device. In addition, the cleansing fluid will spread beyond the short side edges of the suction mouth-piece, so that after each sliding movement over the surface to be cleaned damp strips remain on both sides of the path of the suction nozzle.

It is the object of this invention to provide a device of the type mentioned above, which does not have said drawbacks.

Said object is achieved in that in the device according to the invention two spray nozzles are mounted on the suction mouth-piece adjacent its short sides, said spray nozzles being directed to each other obliquely inwardly.

When the device is in operation, two jets of cleansing fluid obliquely directed to each other are obtained, by which jets directed obliquely towards the floor the dirt, particularly the dried stains, is sprayed off and is forced towards the centre portion of the mouth-piece.

The mouth-piece may advantageously be rotatably mounted on the suction tube, so that also floor parts can be cleaned where only a small working height is available, e.g. under cupboards and beds.

The invention will now be described more in detail with reference to the FIGURE illustrating in perspective view a suction mouth-piece of the device in accordance with the invention.

The suction mouth-piece comprises a frame 1, profiled strips 2 and 3, made of rubber or a similar flexible material and projecting downwards, being secured to said frame. Between strips 2 and 3 there is a room 4 which forms the suction port; at the ends, strip 2 is bent slightly towards strip 3 in order to inclose said room. Room 4 is in communication with a suction device (not illustrated) through the upstanding section 5 of the frame and the suction tube 6 secured thereto.

A channel 7 is mounted on frame 1, said channel being in communication with the source of the cleansing fluid under pressure (not illustrated) through connection 8 and flexible hose 9. At the outer ends of the suction mouth-piece, spray nozzles 10 and 11 are mounted on channel 7, said spray nozzles being directed to each other in an inclined position.

Frame 1 is connected to suction tube 6 by means of a rotatable connection 12 so that the suction tube 6 can be swivelled relative to the frame 1 in such a way that suction tube and frame may extend essentially in one plane, as a result of which even floor parts can be cleaned where a low working height is available, e.g. under cupboards and beds.

When using the device illustrated, the cleansing fluid is directed to the spray nozzles 10 and 11 through hose 9, connection 8 and channel 7, e.g. by opening a hand-operated valve (not illustrated) in hose 9. In the FIGURE, the suction mouth-piece is pulled over the floor towards the right hand part and below, as a result of which the liquid sprayed onto the floor through nozzles 10 and 11 is sucked up by the suction mouth-piece and the suction tube 6. When the device while spraying has reached the end of its path, the supply of the cleansing fluid is cut off and the suction mouth-piece is pulled slightly further in order to suck up the last portion of the cleansing fluid which has been sprayed onto the floor. The nozzle is then positioned next to the starting point of the first path and a second path on the floor is being cleaned in the same manner. These actions are repeated until the entire floor has been cleaned. The jets of cleansing fluid emanating from spray nozzles 10 and 11 come together close behind the centre portion of the suction mouth-piece and the fluid will not flow beyond the reach of the side edges of the suction nozzle. By the fact that in itself small amounts of liquid from the two nozzles flow together, an excellent flotation and a proper rinsing effect is obtained. Due to the wiping action of the flexible strips 2 and 3 and the sucking action inside the mouth-piece an almost dry and clean floor is obtained which can be used at once.

We claim:

1. Device for cleaning floors with the aid of a liquid, said device comprising a tube, said tube at its one end being in communication with a suction device and at its other end opening into an elongated suction mouth-piece, and a conduit, which at its one end is in communication with the source of a cleansing fluid under pressure and at its other end is in communication with at least one spray nozzle, said nozzle being mounted at a fixed position above the suction port of the suction mouth-piece and being directed towards a point lying beyond one of the long sides of the suction mouth-piece, characterized in that two spray nozzles are mounted adjacent the small sides of the suction mouth-piece, said spray nozzles being directed to each other obliquely inwardly.

2. Device in accordance with claim 1, characterized in that the mouth-piece is rotatably mounted on the suction tube.

3. A device for cleaning floors with the aid of a liquid comprising: a hollow, elongated suction mouth piece having a longitudinal axis and having an elongated suction port extending along the lower surface thereof parallel to said longitudinal axis; a suction tube connected to the mouth piece and communicating at one end with the interior of the mouth piece, the suction tube having an opposite end for connection with a suction device; a spray nozzle mounted adjacent each end of the elongated suction mouth piece, said nozzles being directed downwardly and inwardly toward each other; and conduit means for supplying liquid to the nozzles.

4. A device as in claim 3 wherein said mouth piece is straight and wherein said nozzles are offset from said mouth piece in a transverse direction.

* * * * *